United States Patent [19]

Mercatoris

[11] 3,972,515

[45] Aug. 3, 1976

[54] LANCE FOR STEEL SMELTING

[75] Inventor: Robert Mercatoris, Luxembourg, Luxemburg

[73] Assignee: ARBED - Acieries Reunies de Burbach-Eich-Dudelange S.A., Luxembourg, Luxemburg

[22] Filed: Apr. 4, 1975

[21] Appl. No.: 565,113

[30] Foreign Application Priority Data

Apr. 5, 1974 Luxemburg ..... 69797

[52] U.S. Cl. ..... 266/225; 285/133 R

[51] Int. Cl.[2] ..... C21C 5/42

[58] Field of Search ..... 239/132.3, 132.5; 266/34 L, 34 LM; 285/133 R, 320, 331, 133 A; 1206/225, 226

[56] References Cited

UNITED STATES PATENTS

| | | | |
|---|---|---|---|
| 504,739 | 9/1893 | Murray | 285/320 |
| 2,669,511 | 2/1954 | Whitney | 266/34 L |
| 3,170,977 | 2/1965 | Obenchain | 266/34 LM |

FOREIGN PATENTS OR APPLICATIONS

| | | | |
|---|---|---|---|
| 1,529,813 | 5/1968 | France | 285/133 R |

*Primary Examiner*—Roy Lake
*Assistant Examiner*—Paul A. Bell
*Attorney, Agent, or Firm*—Karl F. Ross; Herbert Dubno

[57] ABSTRACT

A steel-smelting lance assembly has a fixed support head having a horizontal lower face and is formed with a plurality of fluid passages opening at the face. A plurality of fluid-carrying conduits are permanently connected to the head and communicate with these passages. A lance tube is provided on its upper end with a connector piece having an upper face and formed with a plurality of passages opening at the face and alignable with the passages of the support head. A pair of bolts pivoted on the support head are engageable in notches on the connector piece so as to align the passages in the connector piece with the passages in the support head and allow the two faces of these elements to be clamped together by tightening nuts on the bolts.

3 Claims, 5 Drawing Figures

LANCE FOR STEEL SMELTING

FIELD OF THE INVENTION

The present invention relates to a blowing lance for a steel-smelting plant and more particularly, to a lance assembly and a method of mounting a lance on a fluid-supply head.

BACKGROUND OF THE INVENTION

Several different types of blowing lances are used in the refining of steel. They are usually suspended vertically and fixed to a movable carriage. Flexible pipes carry cooling and blowing fluids to the lance through a connector arrangement having rigid tubes welded to the body of the lance. In order to change or clean a lance it is necessary to uncouple the several tubes, disconnect the lance from its support, and thereafter transport it to the shop.

The disconnection of the various pipes is, however, a considerable job. Thus if only one lance-carrying carriage is provided substantial time can be lost in the mounting operation. In view of the time necessary to replace the lance the general practice is to have a second lance in reserve which is used during the complicated dismounting and refurbishing operation. In any case the cleaning operation is much too complicated and lengthy to be carried out merely during the pauses in the blowing operation.

The lance is usually changed with the head carrying the tubes and the various connectors. When, as is frequently the case, the lance can no longer be refurbished and reused it is necessary to discard the entire assembly. Since this assembly is extremely expensive, as it must be built to very close tolerances and of relatively costly materials, its replacement considerably increases production costs.

It is absolutely essential, however, that there be no leakage from the lance or its supply head. It is for this reason that hitherto nothing has been used except welded, brazed, and soldered joints in the construction of the lance assembly. It has been suggested to use a telescoping type of lance, but the problem of sealing such an assembly has been so considerable that either a very expensive unit was required, or a very short service life was obtained.

OBJECT OF THE INVENTION

It is therefore an object of the present invention to provide an improved lance assembly.

Another object is the provision of an improved method of mounting a lance on a fluid-supply head.

Yet another object is the provision of an assembly which overcomes the above-given disadvantages.

SUMMARY OF THE INVENTION

These objects are attained according to the present invention in a lance assembly comprising a fixed support head having a horizontal lower face and formed with a plurality of fluid passages opening at said face, and a plurality of fluid-carrying conduits permanently connected to said head and communicating with the passages. A lance tube is provided which has on its upper end a connector piece which itself has an upper face and a plurality of passages opening at the face and alignable (registrable) with the passages of the head. Aligning means is provided for suspending the tube connector piece from the head with the passages aligned and clamping means is provided for securing the connector piece to the head with the faces in sealing contact with each other and the passages in line.

In accordance with the present invention the lance and its connector piece are pendulously suspended below the head such that the passages thereof align, and then the lance is drawn upwardly tightly against the lower face of the supply head so as to form a tight connection between the two.

The system according to the present invention therefore allows the lance tube and a relatively simple connector piece thereon to be separated from the coupling head. This coupling head is fixed, which is not meant to exclude mobility, such as mounting on an overhead carriage, but merely to distinguish it from the lance itself which iss removable and can be physically separated from the coupling head.

The two parts of the assembly can be locked together by means of bolts pivoted on the one assembly and engageable in notches in the other. It is also possible to provide pneumatic or hydraulic clamping, in particular in installations using remote control.

The coupling head comprises an outside housing in which is secured an insert comprising a perforated orifice plate on which are secured several coaxial tube sections. When fitted within the coupling head housing this insert forms a plurality of concentric passages annularly surrounding a central passage. The blowing fluids as well as the coolant are passed through these separate passages. O-rings are provided between the passages of the insert and the housing to insure a fluid-tight fit.

The connector piece carried on the upper end of the lance tube anchors the upper ends of the various coaxial tubes constituting the lance tube. This head is according to the present invention provided with two diametrically opposite radially projecting pins which allow the lance tube readily to be picked up by a grapple or the like. The coaxial tubes are provided internally with bumps that maintain their radial spacing generally uniform.

The connector head according to this invention is formed also with a plurality of annular passages surrounding a central passage and alignable with the passages opening on the lower face of the fluid-supply head. Each of these passages in the connector piece leads to a respective passage defined within a tube or between a pair of tubes of the lance tube. According to this invention a plurality of short frustoconical tube sections are provided and have their upper ends secured to an orifice plate forming the upper surface of the connector piece and having lower ends connected to respective cylindrical tubes forming the lance.

In accordance with this invention one of the faces of the assembly is formed with an annular groove centered about the central axis of the assembly and the other face of the assembly is provided with a similar annular ridge which can fit within the groove so as to align the two parts and insure a tight fit therebetween. In this manner an extremely rigid joint is formed so that considerable thermal and mechanical stresses can be withstood with no danger of leakage. O-rings may again be provided on one of the faces to insure a fluid-tight connection. Thus in use the connector piece and lance tube are brought up by a grapple or the like below the fluid-supply head on which are pivoted the two clamping and aligning bolts. The nuts of these bolts are engaged below notches formed on the connector piece and the lance is then allowed to hang from these bolts. In this position the passages will automatically line up due to the pull of gravity down on the lance so that the two can be connected together simply by tightening the nuts on the bottom of the pivotal bolts to draw the two faces tightly together. Means is provided according to this invention to hold these two bolts in nonvertical positions, extending away from the axis of the assembly so as to facilitate removal of a lance tube.

With the system according to the present invention it is possible to replace a lance tube in the brief time between operations of a steel smelting operation. Thus a considerable reduction in equipment is achieved. In addition if a lance tube needs to be discarded, the complicated fluid supply head need not also be discarded, so that again a considerable reduction in cost is achieved. Furthermore the automatic and accurate centering of the two parts relative to each other eliminates the need of guide rails and the like so that even relatively unskilled workers can change lances according to this invention.

BRIEF DESCRIPTION OF THE DRAWING

The above and other objects, features, and advantages, will become more readily apparent from the following, reference being made to the accompanying drawing in which.

SPECIFIC DESCRIPTION

Figure 1:
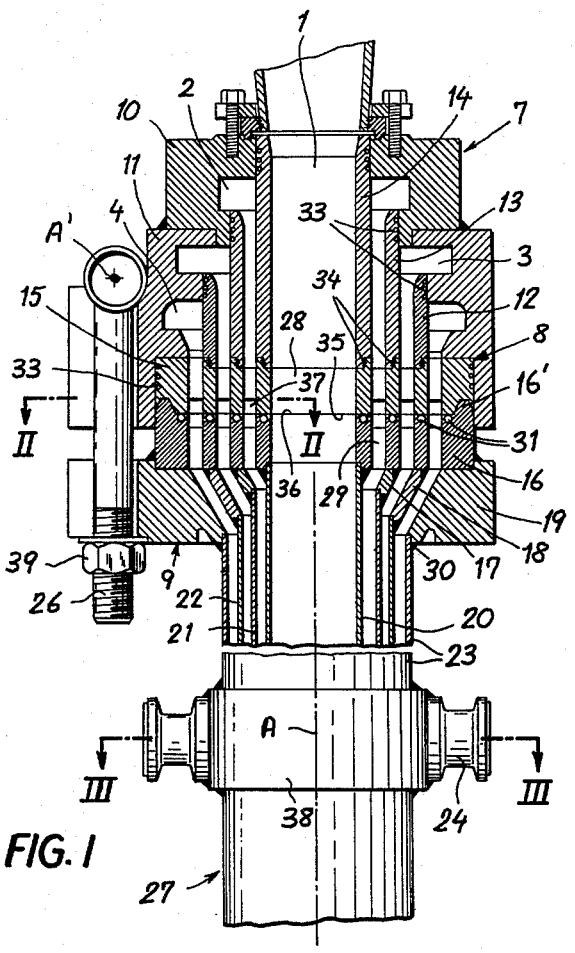
FIG. 1 is a vertical axial section through an assembly according to the present invention.
Figure 2:
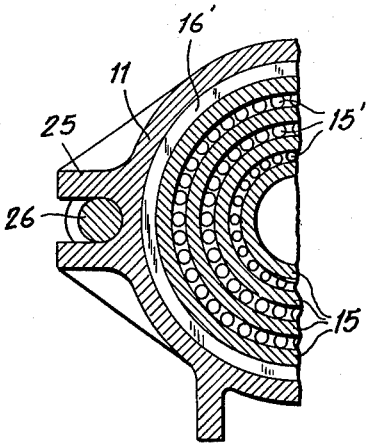
FIGS. 2 and 3 are sections taken along lines II—II and III—III of FIG. 1, respectively.
Figure 3:
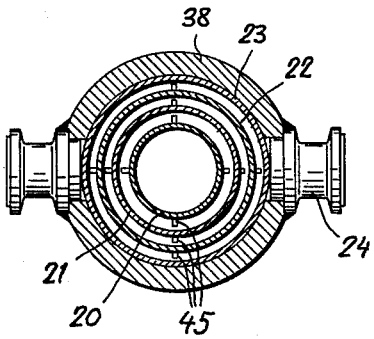
Figure 4:
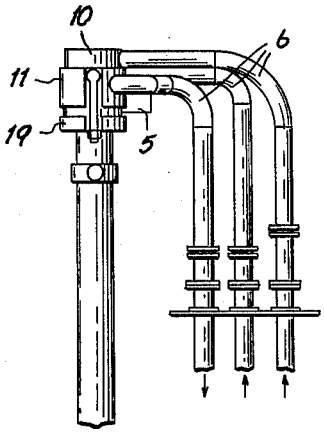
FIG. 4 is a small-scale side view of the assembly in accordance with this invention.

As shown in FIGS. 1 – 3 a lance assembly according to the present assembly basically comprises a normally fixed supply head 7 in which is fitted an insert 8, and a connector piece 9 on the upper end of a lance tube 27. The coupling head 7 has an upper ring 10 to which is welded a lower ring 11 together defining three fluid-distributing chambers 2, 3, and 4. In addition the head 7 is formed with a central throughgoing passage 1 serving for the blowing of oxygen into a steel melt. FIG. 4 shows how various rigid conduits 6 are connected to the pieces 10 and 11 which are secured on a fixed support 5.

The insert 8 is formed of an orifice plate 15 formed with a central hole 28 and three annular and concentric arrays of holes 15'. Three support sections 12, 13, and 14 of tubing are brazed at 34 to the plate 15 so as to form annular chambers communicating with the passages 2, 3, and 4. In addition the central tube 14, which is the longest of the three tube sections, constitutes the central passage 1 defining the axis A of the assembly. O-rings 33 are provided at the upper ends of the tube section 12 – 14 and at the outer periphery of the ring 15 to form a fluid-tight seal between this insert 8 and the housing 7.

The upper end of the lance 27 is provided with a connector piece 9 formed of an outer ring 19 having a frustoconical inner hole, and two short frustoconical tube sections 17 and 18 all welded to another orifice disk 16. This orifice disk 16 has an upwardly extending ridge 16' centered on the axis A and received within a corresponding groove formed between the plate 15 and the element 11. Coaxial thin-walled tubes 20, 21, 22, and 23 are secured to the elements 16, 17, 18 and 19, respectively and communicate through holes 29 and the holes 15' with the passages 2, 3, and 4, with the inner tube 20 lying as a continuation of the tube 14. The lower face 35 of the head 7 and the upper face 36 of the connector piece 9 and therefore both generally flat, with the exception of the mating groove and ridge 16', and are both formed with rings of square-section grooves 37 at the perforations 15' and 29 so that fluid communication through this arrangement is possible even when the elements are angularly offset to one another.

The lance 27 is provided with a collar 38 on which is mounted a pair of pickup pins 24 that allow the lance assembly readily to be carried by a standard fork on a grapple. In addition there is pivoted on the element 11 a pair of diametrically opposite bolts 26 pivotal about parallel axes A' offset from and perpenddicular to the axis A. The ring 19 is provided with a pair of ears 25 between which the bolt 26 can be engaged. A nut 39 on each of these bolts 26 can then be tightened up against the bottom of the connector piece 9 so as to clamp it securely against the face 35 of the head 7 as illustrated. FIG. 3 also shows how the cylindrical tubes 20, 21, and 22 are formed with diametrically opposite outwardly radially extending projections 45 that maintain a minimum spacing between these tubes so that the passages formed thereby are always clear.

In the arrangement shown in FIGS. 1 – 4 the tube 21 is made of copper whereas the tubes 22 and 23 are made of mild steel. In addition the elements 10 and 11 of the head 7 and elements 18 and 19 of the piece 9 are formed of mild steel. Stainless steel is used for the tube 14 as well as for the orifice plate 15 and 16. Stainless steel is similarly used for the short tube section 17 and the inner tube 20.

Figure 5:
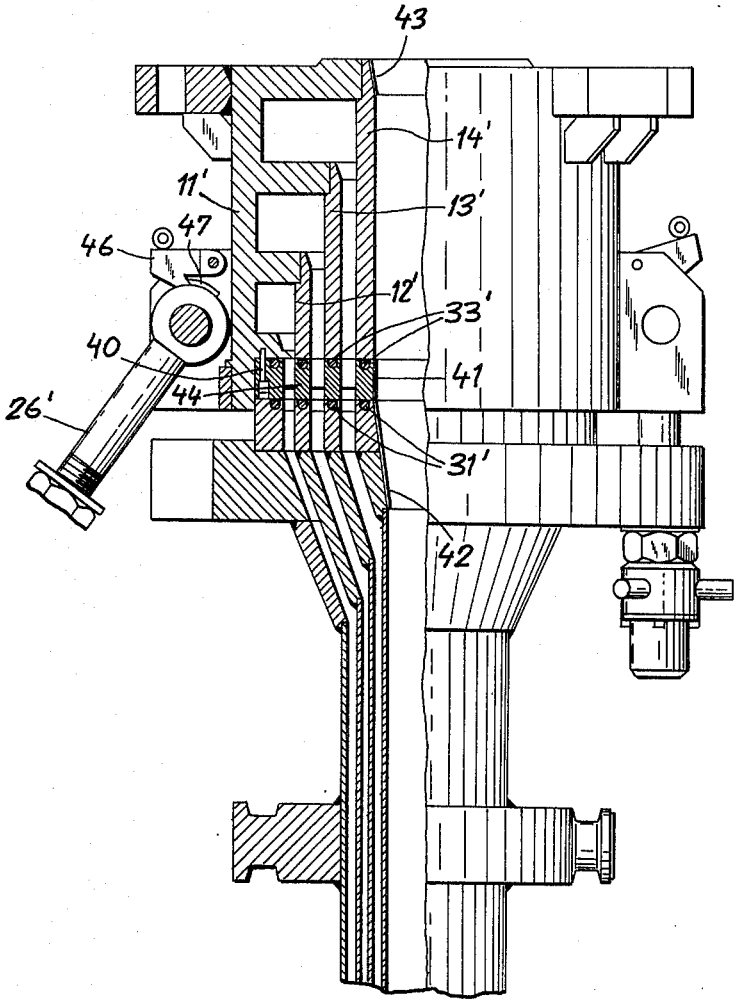
FIG. 5 is a partially sectional view of another lance assembly according to the present invention.

The arrangement shown in FIG. 5 is substantially identical to that shown in FIGS. 1 – 4, with primed reference numbers being used for functionally identical structures. Here however an orifice plate 44 taking the place of orifice plate 15 is secured by means of short Allen screws 40 to the element 11'. The upper surface of the orifice plate 44 is provided with O-rings 33' engaging the ends of the tube sections 12', 13', and 14'. In addition the lower surface of this orifice plate 44 is provided with other O-rings 31' as in FIGS. 1 – 4. In this arrangement surface 41, 42, and 43 are protected from abrasion by a layer of tungsten. This arraangement shown in FIG. 5 is particularly easy to manufacture and machine.

Also shown in FIG. 5 are catches 46 which engage over bosses 47 on the bolts 26' so as to be able to hold these bolts as shown to the left in FIG. 5 in a position allowing the lance to be brought into position. The lifting of the dog of the latch 46 allows the bolt 26' to drop down as shown to the right in FIG. 5.

I claim:

1. An assembly for mounting a blowing lance for a metallurgical installation upon a support structure, comprising:

a fluid supply head member fixed to said structure and formed with a plurality of fluid passages;

a plurality of fluid-carrying conduits permanently secured to said head member and respectively communicating with said passages;

a connecting member fixed to said lance and formed with a plurality of passages communicating with corresponding ducts of said lance;

clamping means for securing said members in axial alignment and for drawing same together when said members are axially aligned; and respective rigid orifice plates on each of said members provided with orifices respectively communicating with the passages of their respective members, and concentric annular ridges separating the orifices of the respective passages from one another, the annular ridges of said orifice plates registering with each other upon axial alignment of said members for sealingly engaging the annular ridges of an opposing orifice plate when said members are drawn together, one of said members being formed as a socket receiving said orifice plates and said one of said members and the respective orifice plate defining an aligning formation engageably by a complementary formation of the other orifice plate.

2. The assembly defined in claim 1 wherein said one of said members is said head member and the respective orifice plate thereof is received within a recess formed in said head member and opening in the direction of said lance, the latter orifice plate defining with a wall of said recess an annular tapered groove consituting said aligning formation, said orifice plate of said connecting member being provided with a conical ridge constituting said complementary formation and received in said groove, said clamping means including a pair of bolts pivotal about horizontal axes on said head member, and a pair of bifurcated lugs on said connecting member receiving said bolts, and nuts on each of said bolts bearing against said lugs.

3. The assembly defined in claim 2 wherein the passages of said members include a central passage of substantially constant cross section upon axial alignment of said members and said orifice plates and at least two coaxial outer passages surrounding said central passage, said assembly further comprising O-rings between said annular ridges of said orifice plates, and duct means for supporting said bolts in swung-out positions wherein said bolts are withdrawn from said lugs.

* * * * *